US008926771B2

(12) United States Patent
Agazzi et al.

(10) Patent No.: US 8,926,771 B2
(45) Date of Patent: Jan. 6, 2015

(54) SEAMLESS PRECISION STEEL TUBES WITH IMPROVED ISOTROPIC TOUGHNESS AT LOW TEMPERATURE FOR HYDRAULIC CYLINDERS AND PROCESS FOR OBTAINING THE SAME

(75) Inventors: Gianmario Agazzi, Milan (IT); Emanuele Paravicini Bagliani, Brembate di Sopra (IT); Andrea Poli, Genoa (IT)

(73) Assignee: Tenaris Connections Limited, Kingstown (VC)

( * ) Notice: Subject to any disclaimer, the term of this patent is extended or adjusted under 35 U.S.C. 154(b) by 1650 days.

(21) Appl. No.: 12/306,917

(22) PCT Filed: Jun. 29, 2006

(86) PCT No.: PCT/EP2006/063701

§ 371 (c)(1),
(2), (4) Date: Nov. 2, 2009

(87) PCT Pub. No.: WO2008/000300

PCT Pub. Date: Jan. 3, 2008

(65) Prior Publication Data

US 2010/0068549 A1 Mar. 18, 2010

(51) Int. Cl.

| | |
|---|---|
| ***C21D 9/08*** | (2006.01) |
| ***C21D 8/10*** | (2006.01) |
| ***C21D 1/18*** | (2006.01) |
| ***C22C 38/02*** | (2006.01) |
| ***C22C 38/04*** | (2006.01) |

(52) U.S. Cl.

CPC ..... *C21D 8/105* (2013.01); *C21D 1/185* (2013.01); *C21D 9/08* (2013.01); *C22C 38/02* (2013.01); *C22C 38/04* (2013.01)

USPC ..... 148/593; 148/653; 148/654

(58) Field of Classification Search

USPC ..... 148/593

See application file for complete search history.

(56) References Cited

U.S. PATENT DOCUMENTS 3,413,166 A 11/1968 Zackay et al.
3,655,465 A * 4/1972 Snape et al. ..... 148/621

(Continued)

FOREIGN PATENT DOCUMENTS

AR 0050159 A1 10/2006
EP 0 092 815 11/1983

(Continued)

OTHER PUBLICATIONS

D. Smyth, R.G. Lessard, and F. Minden, Steel Tubular Products, Properties and Selection: Irons, Steels, and High-Performance Alloys, vol. 1, ASM Handbook, ASM International, 1990, p. 327-336.*

(Continued)

*Primary Examiner* — Jessee Roe
*Assistant Examiner* — Christopher Kessler
(74) *Attorney, Agent, or Firm* — Knobbe Martens Olson & Bear LLP

(57) ABSTRACT

Process for manufacturing seamless precision steel tubes with improved isotropic toughness at low temperature for hydraulic cylinders comprising the following steps; —(i) providing a steel having a composition comprising 0.06-0.15% by weight of carbon, 0.30-2.5% by weight of Mn, and 0.10-0.60% by weight of Si, —(ii) hot-rolling the said steel at a temperature higher than Ac3 such as to obtain a seamless steel tube, —(iii) heating the said seamless steel tube at a temperature in the range between Ac1 and Ac3, —(iv) quenching the said heated seamless steel tube, such as to establish a dual (or multi-) phase microstructure in the steel employed, composed of ferrite and martensite and optionally bainite and/or retained austenite, —(v) cold drawing the quenched seamless steel tube such as to provide a seamless precision steel tube of the desired dimensions, —(vi) subjecting the so-obtained seamless precision steel tube to stress relieving treatment to improve its isotropic toughness, and optionally —(vii) straightening the so-obtained seamless precision steel tube with improved toughness.

23 Claims, 2 Drawing Sheets

(56) References Cited

U.S. PATENT DOCUMENTS

| | | | | |
|---|---|---|---|---|
| 3,810,793 | A | 5/1974 | Heller | |
| 3,915,697 | A | 10/1975 | Giuliani et al. | |
| 4,231,555 | A | 11/1980 | Saito | |
| 4,336,081 | A | 6/1982 | Hijikata et al. | |
| 4,354,882 | A * | 10/1982 | Greer | 148/541 |
| 4,376,528 | A | 3/1983 | Ohshimatani et al. | |
| 4,379,482 | A | 4/1983 | Suzuki et al. | |
| 4,407,681 | A | 10/1983 | Ina et al. | |
| 4,526,628 | A | 7/1985 | Ohno et al. | |
| 4,721,536 | A | 1/1988 | Koch et al. | |
| 4,812,182 | A | 3/1989 | Fang et al. | |
| 4,814,141 | A | 3/1989 | Imai et al. | |
| 5,352,406 | A | 10/1994 | Barteri et al. | |
| 5,454,883 | A | 10/1995 | Yoshie et al. | |
| 5,538,566 | A | 7/1996 | Gallagher | |
| 5,592,988 | A | 1/1997 | Meroni et al. | |
| 5,598,735 | A | 2/1997 | Saito et al. | |
| 5,879,474 | A | 3/1999 | Bhadeshia et al. | |
| 5,944,921 | A | 8/1999 | Cumino et al. | |
| 5,993,570 | A | 11/1999 | Gray | |
| 6,030,470 | A | 2/2000 | Hensger et al. | |
| 6,188,037 | B1 | 2/2001 | Hamada et al. | |
| 6,196,530 | B1 | 3/2001 | Muhr et al. | |
| 6,217,676 | B1 | 4/2001 | Takabe et al. | |
| 6,248,187 | B1 | 6/2001 | Asahi et al. | |
| 6,267,828 | B1 | 7/2001 | Kushida et al. | |
| 6,311,965 | B1 | 11/2001 | Muhr et al. | |
| 6,384,388 | B1 | 5/2002 | Anderson et al. | |
| 6,514,359 | B2 | 2/2003 | Kawano | |
| 6,632,296 | B2 | 10/2003 | Yoshinaga et al. | |
| 6,648,991 | B2 | 11/2003 | Turconi et al. | |
| 6,669,285 | B1 | 12/2003 | Park et al. | |
| 6,669,789 | B1 | 12/2003 | Edelman et al. | |
| 6,682,610 | B1 | 1/2004 | Inoue | |
| 6,683,834 | B2 | 1/2004 | Ohara et al. | |
| 6,709,534 | B2 | 3/2004 | Kusinski et al. | |
| 6,767,417 | B2 | 7/2004 | Fujita et al. | |
| 6,958,099 | B2 | 10/2005 | Nakamura et al. | |
| 7,074,283 | B2 | 7/2006 | Omura | |
| 7,083,686 | B2 | 8/2006 | Itou | |
| 7,118,637 | B2 | 10/2006 | Kusinski et al. | |
| 7,214,278 | B2 | 5/2007 | Kusinski et al. | |
| 7,264,684 | B2 | 9/2007 | Numata et al. | |
| 7,635,406 | B2 | 12/2009 | Numata et al. | |
| 7,744,708 | B2 | 6/2010 | López et al. | |
| 7,862,667 | B2 | 1/2011 | Turconi et al. | |
| 8,002,910 | B2 | 8/2011 | Tivelli et al. | |
| 8,007,601 | B2 | 8/2011 | López et al. | |
| 8,007,603 | B2 | 8/2011 | Garcia et al. | |
| 8,016,362 | B2 | 9/2011 | Itoga | |
| 8,414,715 | B2 | 4/2013 | Altschuler et al. | |
| 2001/0035235 | A1 | 11/2001 | Kawano | |
| 2002/0011284 | A1 | 1/2002 | Von Hagen et al. | |
| 2003/0019549 | A1 | 1/2003 | Turconi et al. | |
| 2003/0111146 | A1 | 6/2003 | Kusinski et al. | |
| 2003/0116238 | A1 | 6/2003 | Fujita | |
| 2003/0155052 | A1 | 8/2003 | Kondo et al. | |
| 2003/0165098 | A1 | 9/2003 | Ohara et al. | |
| 2004/0118490 | A1 | 6/2004 | Klueh et al. | |
| 2004/0131876 | A1 | 7/2004 | Ohgami et al. | |
| 2004/0139780 | A1 | 7/2004 | Cai et al. | |
| 2005/0076975 | A1 | 4/2005 | Lopez et al. | |
| 2005/0087269 | A1 * | 4/2005 | Merwin | 148/590 |
| 2006/0124211 | A1 * | 6/2006 | Takano et al. | 148/593 |
| 2006/0137781 | A1 | 6/2006 | Kusinski et al. | |
| 2006/0169368 | A1 * | 8/2006 | Lopez et al. | 148/332 |
| 2006/0243355 | A1 | 11/2006 | Haiderer et al. | |
| 2007/0089813 | A1 | 4/2007 | Tivelli | |
| 2007/0137736 | A1 | 6/2007 | Omura et al. | |
| 2007/0216126 | A1 | 9/2007 | Lopez et al. | |
| 2009/0101242 | A1 | 4/2009 | Lopez et al. | |
| 2010/0068549 | A1 | 3/2010 | Agazzi | |
| 2010/0294401 | A1 | 11/2010 | Gomez | |
| 2010/0319814 | A1 | 12/2010 | Perez | |
| 2010/0327550 | A1 | 12/2010 | Lopez et al. | |
| 2011/0097235 | A1 | 4/2011 | Turconi et al. | |
| 2011/0247733 | A1 | 10/2011 | Arai et al. | |

FOREIGN PATENT DOCUMENTS

| | | | |
|---|---|---|---|
| EP | 0 658 632 | | 6/1995 |
| EP | 0 753 595 | | 1/1997 |
| EP | 0 828 007 | A | 3/1998 |
| EP | 0 989 196 | | 3/2000 |
| EP | 01027944 | B1 | 8/2000 |
| EP | 1 277 848 | | 1/2003 |
| EP | 1 288 316 | | 3/2003 |
| EP | 1 413 639 | | 4/2004 |
| EP | 1 717 324 | | 11/2006 |
| EP | 1 914 324 | | 4/2008 |
| EP | 2 028 284 | | 2/2009 |
| EP | 2 133 442 | | 12/2009 |
| JP | 60-086209 | | 5/1985 |
| JP | 60-215719 | | 10/1985 |
| JP | 36025719 | | 10/1985 |
| JP | 61270355 | | 11/1986 |
| JP | 63004046 | A2 | 1/1988 |
| JP | 63004047 | A2 | 1/1988 |
| JP | 63230847 | A2 | 9/1988 |
| JP | 63230851 | A2 | 9/1988 |
| JP | 01 259124 | A2 | 10/1989 |
| JP | 01 259125 | A2 | 10/1989 |
| JP | 01 283322 | A2 | 11/1989 |
| JP | 05-098350 | | 12/1990 |
| JP | 403006329 | A | 1/1991 |
| JP | 04 021718 | A2 | 1/1992 |
| JP | 04 107214 | | 4/1992 |
| JP | 04 231414 | A2 | 8/1992 |
| JP | 05 287381 | A2 | 11/1993 |
| JP | 06-093339 | | 4/1994 |
| JP | 06 172859 | A2 | 6/1994 |
| JP | 06-220536 | | 8/1994 |
| JP | 07 041856 | A2 | 2/1995 |
| JP | 07 197125 | A2 | 8/1995 |
| JP | 08 311551 | | 11/1996 |
| JP | 09 067624 | A2 | 3/1997 |
| JP | 09-235617 | | 9/1997 |
| JP | 10 140250 | | 5/1998 |
| JP | 10176239 | | 6/1998 |
| JP | 10 280037 | A | 10/1998 |
| JP | 11 050148 | A | 2/1999 |
| JP | 11140580 | | 5/1999 |
| JP | 11229079 | | 8/1999 |
| JP | 2000-063940 | | 2/2000 |
| JP | 2000-313919 | A2 | 11/2000 |
| JP | 2001-131698 | | 5/2001 |
| JP | 2001-164338 | | 6/2001 |
| JP | 2001-172739 | A2 | 6/2001 |
| JP | 2001-271134 | | 10/2001 |
| JP | 2002-096105 | A2 | 4/2002 |
| JP | 2004-011009 | | 1/2004 |
| JP | 60 174822 | | 9/2005 |
| KR | 0245031 | | 3/2000 |
| WO | WO 96/22396 | | 7/1996 |
| WO | WO 00/70107 | | 11/2000 |
| WO | WO 01/88210 | | 11/2001 |
| WO | WO 03/033856 | | 4/2003 |
| WO | WO 2004/031420 | | 4/2004 |
| WO | WO 2004/097059 | A1 | 11/2004 |
| WO | WO 2007/017161 | | 2/2007 |
| WO | WO 2008/003000 | | 1/2008 |
| WO | WO 2008/127084 | A2 | 10/2008 |
| WO | WO 2009/044297 | | 4/2009 |
| WO | WO 2009/065432 | | 5/2009 |

OTHER PUBLICATIONS

"Seamless Steel Tubes for Pressure Purposes-Technical Delivery Conditions-Part 1: Non-alloy Steel Tubes with Specified Room Temperature Properties" *British Standard* BS EN 10216-1:2002 E:1-26, published May 2002.

"Seamless Steel Tubes for Pressure Purposes-Technical Delivery Conditions-Part2: Non-alloy and Alloy Steel Tubes with Specified

(56) References Cited

OTHER PUBLICATIONS

Elevated Temperature Properties" British Standard BS EN 10216-2:2002+A2:2007:E:1-45, published Aug. 2007.
"Seamless Steel Tubes for Pressure Purposes-Technical Delivery Conditions-Part 3: Alloy Fine Grain Steel Tubes" *British Standard* BS EN 10216-3:2002 +A1:2004 E:1-34, published Mar. 2004.
"Seamless Steel Tubes for Pressure Purposes-Technical Delivery Conditions-Part 4: Non-alloy and Alloy Steel Tubes with Specified Low Temperature Properties" *British Standard* BS EN 10216-4: 2002 + A1:2004 E:1-30, published Mar. 2004.
Pressure Equipment Directive 97/23/EC, May 29, 1997, downloaded from website: http://ec.europa.eu/enterprise/pressure_equipment/ped/index_en.html on Aug. 4, 2010.
International Search Report and Written Opinion for PCT /EP2006/063701, dated Apr. 2, 2007.
International Preliminary Report on Patentability for PCT/EP2006/063701, dated Sep. 18, 2008.
Aggarwal, R. K., et al.: "Qualification of Solutions for Improving Fatigue Life at SCR Touch Down Zone", Deep Offshore Technology Conference, Nov. 8-10, 2005, Vitoria, Espirito Santo, Brazil, in 12 pages.
Anelli, E., D. Colleluori, M. Pontremoli, G. Cumino, A. Izquierdo, H. Quintanilla, "Metallurgical design of advanced heavy wall seamless pipes for deep-water applications", 4th International Conference on Pipeline Technology, May 9 to 13, 2004, Ostend, Belgium.
Asahi, et al., Development of Ultra-high-strength Linepipe, X120, Nippon Steel Technical Report, Jul. 2004, Issue 90, pp. 82-87.
ASM Handbook, Mechanical Tubing and Cold Finishing, Metals Handbook Desk Edition, (2000), 5 pages.
Bai, M., D. Liu, Y. Lou, X. Mao, L. Li, X. Huo, "Effects of Ti addition on low carbon hot strips produced by CSP process", Journal of University of Science and Technology Beijing, 2006, vol. 13, N° 3, p. 230.
Beretta, Stefano et al., "Fatigue Assessment of Tubular Automotive Components in Presence of Inhomogeneities", Proceedings of IMECE2004, ASME International Mechanical Engineering Congress, Nov. 13-19, 2004, pp. 1-8.
Berner, Robert A., "Tetragonal Iron Sulfide", Science, Aug. 31, 1962, vol. 137, Issue 3531, pp. 669.
Berstein et al.,"The Role of Traps in the Microstructural Control of Hydrogen Embrittlement of Steels" Hydrogen Degradation of Ferrous Alloys, Ed. T. Oriani, J. Hirth, and M. Smialowski, Noyes Publications, 1988, pp. 641-685.
Boulegue, Jacques, "Equilibria in a sulfide rich water from Enghien-les-Bains, France", Geochimica et Cosmochimica Acta, Pergamom Press, 1977, vol. 41, pp. 1751-1758, Great Britain.
Bruzzoni et al., "Study of Hydrogen Permeation Through Passive Films on Iron Using Electrochemical Impedance Spectroscopy", PhD Thesis, 2003, Universidad Nacional del Comahue de Buenos Aires, Argentina.
Cancio et al., "Characterization of microalloy precipitates in the austenitic range of high strength low alloy steels", Steel Research, 2002, vol. 73, pp. 340-346.
Chang, L.C., "Microstructures and reaction kinetics of bainite transformation in Si-rich steels," XP0024874, Materials Science and Engineering, vol. 368, No. 1-2, Mar. 15, 2004, pp. 175-182, Abstract, Table 1.
Clark, A. Horrell, "Some Comments on the Composition and Stability Relations of Mackinawite", Neues Jahrbuch fur Mineralogie, 1966, vol. 5, pp. 300-304, London, England.
Craig, Bruce D., "Effect of Copper on the Protectiveness of Iron Sulfide Films", Corrosion, National Association of Corrosion Engineers, 1984, vol. 40, Issue 9, pp. 471-474.
De Medicis, Rinaldo, "Cubic FeS, A Metastable Iron Sulfide", Science, American Association for the Advancement of Science, Steenbock Memorial Library, Dec. 11, 1970, vol. 170, Issue 3963, pp. 723-728.
Echaniz, G., Morales, C., Perez, T., "Advances in Corrosion Control and Materials in Oil and Gas Production" Papers from Eurocorr 97 and Eurocorr 98, 13, P. S. Jackman and L.M. Smith, Published for the European Federation of Corrosion, No. 26, European Federation of Corrosion Publications, 1999.
Gojic, Mirko and Kosec, Ladislav, "The Susceptibility to the Hydrogen Embrittlement of Low Alloy Cr and CrMo Steels", ISIJ International, 1997, vol. 37, Issue 4, pp. 412-418.
Heckmann, et al., Development of low carbon Nb-Ti-B microalloyed steels for high strength large diameter linepipe, Ironmaking and Steelmaking, 2005, vol. 32, Issue 4, pp. 337-341.
Howells, et al.: "Challenges for Ultra-Deep Water Riser Systems", IIR, London, Apr. 1997, 11 pages.
Hutchings et al., "Ratio of Specimen thickness to charging area for reliable hydrogen permeation measurement", British Corrosion. Journal, 1993, vol. 28, Issue 4, pp. 309-312.
Iino et al., "Aciers pour pipe-lines resistant au cloquage et au criquage dus a l'hydrogene", Revue de Metallurgie, 1979, vol. 76, Issue 8-9, pp. 591-609.
Ikeda et al., "Influence of Environmental Conditions and Metallurgical Factors on Hydrogen Induced Cracking of Line Pipe Steel", Corrosion/80, National Association of Corrosion Engineers, 1980, vol. 8, pp. 8/1-8/18, Houston, Texas.
Izquierdo, et al.: "Qualification of Weldable X65 Grade Riser Sections with Upset Ends to Improve Fatigue Performance of Deepwater Steel Catenary Risers", Proceedings of the Eighteenth International Offshore and Polar Engineering Conference, Vancouver, BC, Canada, Jul. 6-11, 2008, p. 71.
Johnston, P. W., G.Brooks, "Effect of Al2O3 and TiO2 Additions on the Lubrication Characteristics of Mould Fluxes", Molten Slags, Fluxes and Salts '97 Conference, 1997 pp. 845-850.
Keizer, Joel, "Statistical Thermodynamics of Nonequilibrium Processes", Spinger-Verlag, 1987.
Kishi, T., H.Takeucgi, M.Yamamiya, H.Tsuboi, T.Nakano, T.Ando, "Mold Powder Technology for Continuous Casting of Ti-Stabilized Stainless Steels", Nippon Steel Technical Report, No. 34, Jul. 1987, pp. 11-19.
Korolev, D. F., "The Role of Iron Sulfides in the Accumulation of Molybdenum in Sedimentary Rocks of the Reduced Zone", Geochemistry, 1958, vol. 4, pp. 452-463.
Lee, Sung Man and Lee, Jai Young, "The Effect of the Interface Character of TiC Particles on Hydrogen Trapping in Steel", Acta Metall., 1987, vol. 35, Issue 11, pp. 2695-2700.
Mishael, et al., "Practical Applications of Hydrogen Permeation Monitoring," Corrosion, Mar. 28-Apr. 1, 2004, Corrosion 2004, Nacional Association of Corrosion Engineers, vol. Reprint No. 04476.
Morice et al., "Moessbauer Studies of Iron Sulphides", J. Inorg. Nucl. Chem., 1969, vol. 31, pp. 3797-3802.
Mukongo, T., P.C.Pistorius, and A.M.Garbers-Craig, "Viscosity Effect of Titanium Pickup by Mould Fluxes for Stainless Steel", Ironmaking and Steelmaking, 2004, vol. 31, No. 2, pp. 135-143.
Mullet et al., "Surface Chemistry and Structural Properties of Mackinawite Prepared by Reaction of Sulfide Ions with Metallic Iron", Geochemica et Cosmochemica Acta, 2002, vol. 66, Issue 5, pp. 829-836.
Murcowchick, James B. and Barnes, H.L., "Formation of a cubic FeS", American Mineralogist, 1986, vol. 71, pp. 1243-1246.
Nagata, M., J. Speer, D. Matlock, "Titanium nitride precipitation behavior in thin slab cast high strength low alloyed steels", Metallurgical and Materials Transactions A, 2002 ,vol. 33A, p. 3099-3110.
Nakai et al., "Development of Steels Resistant to Hydrogen Induced Cracking in Wet Hydrogen Sulfide Environment", Transactions of the ISIJ, 1979, vol. 19, pp. 401-410.
PCT International Response to the Written Opinion dated Apr. 2005, for PCT/EP2006/063701, dated Jun. 29, 2006.
PCT Preliminary Report on Patentability re App. No. PCT/EP2006/063701, dated Sep. 18, 2008, in 9 pages.
Prevéy, Paul, et al., "Introduction of Residual Stresses to Enhance Fatigue Performance in the Initial Design", Proceedings of Turbo Expo 2004, Jun. 14-17, 2004, pp. 1-9.
Rickard, D.T., "The Chemistry of Iron Sulphide Formation at Low Tempuratures", Stockholm Contrib. Geol., 1969, vol. 26, pp. 67-95.

(56) References Cited

OTHER PUBLICATIONS

Riecke, Ernst and Bohnenkamp, Konrad, "Uber den Einfluss von Gittersoerstellen in Eisen auf die Wassersroffdiffusion", Z. Metallkde.., 1984, vol. 75, pp. 76-81.
Shanabarger, M.R. and Moorhead, R. Dale, "H2O Adsorption onto clean oxygen covered iron films", Surface Science, 1996, vol. 365, pp. 614-624.
Shoesmith, et al., "Formation of Ferrous Monosulfide Polymorphs During Corrosion of Iron by Aqueous Hydrogen Sulfide at 21 degrees C", Journal of the Electrochemical Society, 1980, vol. 127, Issue 5, pp. 1007-1015.
Skoczylas, G., A.Dasgupta, R.Bommaraju, "Characterization of the chemical interactions during casting of High-titanium low carbon enameling steels", 1991 Steelmaking Conference Proceeding, pp. 707-717.
Smyth, D., et al.: Steel Tublar Products, Properties and Selection: Irons, Steels, and High-Performance Alloys, vol. 1, ASM Handbook, ASM International, 1990, p. 327-336.
Spry, Alan, "Metamorphic Textures", Perganom Press, 1969, New York.
Taira et al., "HIC and SSC Resistance of Line Pipes for Sour Gas Service", Nippon Kokan Technical Report, 1981, vol. 31, Issue 1-13.
Taira et al., "Study on the Evaluation of Environmental Condition of Wet Sour Gas", Corrosion 83 (Reprint. No. 156, National Association of Corrosion Engineers), 1983, pp. 156/2-156/13, Houston, Texas.
Takeno et al., "Metastable Cubic Iron Sulfide—With Special Reference to Mackinawite", American Mineralogist, 1970, vol. 55, pp. 1639-1649.
Tenaris Newsletter for Pipeline Services, Apr. 2005, p. 1-8.
Tenaris Newsletter for Pipeline Services, May 2003, p. 1-8.
Thethi, et al.: "Alternative Construction for High Pressure High Temperature Steel Catenary Risers", OPT USA, Sep. 2003, p. 1-13.
Thewlis, G., Weldability of X100 linepipe, Science and Technology of Welding and Joining, 2000, vol. 5, Issue 6, pp. 365-377.
Tivelli, M., G. Cumino, A. Izquierdo, E. Anelli, A. Di Schino, "Metallurgical Aspects of Heavy Wall—High Strength Seamless Pipes for Deep Water Applications", RioPipeline 2005, Oct. 17 to 19, 2005, Rio (Brasil), Paper n° IBP 1008_05.
Todoroki, T. Ishii, K. Mizuno, A. Hongo, "Effect of crystallization behavior of mold flux on slab surface quality of a Ti-bearing Fe-Cr-Ni super alloy cast by means of continuous casting process", Materials Science and Engineering A, 2005, vol. 413-414, p. 121-128.
Turconi, G. L.: "Improvement of resistance to SSC initiation and propagation of high strength OCTG through microstruture and precipitation control"; "Paper 01077", NACE International, Houston, TX, Mar. 16, 2001. (XP009141583).
Vaughan, D. J. and Ridout, M.S., "Moessbauer Studies of Some Sulphide Minerals", J. Inorg Nucl. Chem., 1971, vol. 33, pp. 741-746.
Wegst, C.W., "Stahlüssel", Auflage 1989, Seite 119, 2 pages.
D.O.T. 178.68 Spec. 39, pp. 831-840, Non reusable (non refillable) cylinders, Oct. 1, 2002.
Fang, Hong-Sheng, et al.: "The Developing Prospect of Air-cooled Baintitic Steels", International Journal of Issi, vol. 2, No. 2, Feb. 1, 2005, pp. 9-18.

* cited by examiner

SEAMLESS PRECISION STEEL TUBES WITH IMPROVED ISOTROPIC TOUGHNESS AT LOW TEMPERATURE FOR HYDRAULIC CYLINDERS AND PROCESS FOR OBTAINING THE SAME

RELATED APPLICATIONS

This application is a U.S. National Phase of International Application No. PCT/EP2006/063701, filed Jun. 29, 2006 and published in English on Jan. 3, 2008.

FIELD OF THE INVENTION

The invention is related to seamless precision steel tubes with improved isotropic toughness at low temperature for hydraulic cylinders. The invention is also related to a new process for obtaining the same.

TECHNICAL BACKGROUND

The hydraulic cylinder is an actuator that converts hydraulic energy into mechanical energy. It produces linear motion and imparts a force that depends on the pressure of the oil and on the area of the piston. It has many applications in oil hydraulics systems, and is employed for example in earth moving machines, cranes, presses, industrial machinery etc.

The device is composed of a cylindrical housing (also called bore or barrel), a rod with a piston, closed by a cap on both ends. With the term "tubes for hydraulic cylinders" we mean the tubes for the production of the external cylindrical housing, which is common to all types of hydraulic cylinders, see e.g. FIG. 1.

Technical requirements of this product can be reassumed in the following way.

To ensure proper transmission of force and to avoid losses of the hydraulic medium, the barrel must have good toughness and narrow geometric tolerances in the inner diameter. If these high precision characteristics cannot be directly or almost obtained through the metallurgic production process of the seamless pipe employed for the barrel, downstream machining operations comprising, in this case, highly ablative surface treatments (e.g. skiving plus roller burnishing or honing or boring plus honing) are necessary. Importantly, the former machining step increases the production costs sensibly, since the highly ablative treatments must be followed in their turn by a (stepwise) surface refining, to equalize the newly created surface. In general, the most economic solution is the process of skiving and burnishing, that requires precise and repeatable dimensional tolerances. If these conditions are not met, more expensive solutions must be adopted, for example boring plus honing or boring plus skiving and burnishing.

It follows thus that the final machining costs increase in an over proportional manner with growing geometric tolerances.

The barrel undergoes fatigue cycles during its life and on top of that, in many applications such as its employment in earth moving machines, cranes and others, it must be able to operate in external conditions of low temperature. Toughness (at least down to −20° C. and preferably down to −40° C.) is therefore an essential requirement to have "leak before break" behaviour, avoiding in this way brittle fracture, which typically involves a dangerous condition. Indeed, for a number of applications such as pressure equipment, the Laws already demand ductile behaviour in burst tests, or longitudinal and transversal toughness of 27 J at the minimum of the operating temperature [1,2,3].

The manufacturing process of the cylinder barrel is economically more advantageous using a cold finished tube instead of a hot rolled tube, due to the possibility to get:

Dimensions closer to the final size, with narrower tolerances, thus making the downstream machining process, if any, comparably cheap, due to the only very limited amount of dimensional correction required.

Higher tensile properties.

Better surface quality.

The standard cycle is, therefore:

Hot rolling-pickling-cold drawing-stress relieving-straightening-surface machining-cut-assemblage of the parts.

In the standard cycle, cold drawing and stress relieving are necessary to increase the yield strength to the levels commonly required (at least 520 MPa, preferably 620 MPa), but they reduce material toughness and more importantly they cause a high anisotropy between longitudinal and transversal direction of the tube, in particular to the detriment of transversal toughness. Therefore, with the standard cycle, it is not possible to ensure the low temperature characteristics required e.g. by applications in specific climatic conditions as they may be encountered e.g. in northern Europe. Indeed, in such cases even at room temperatures the transversal toughness is not enough in order to avoid brittle fracture.

The alternative cycles today available to improve the toughness at low temperature are:

(1) Hot rolling-cold drawing-normalisation-straightening-surface machining-cut-assemblage of the parts.

This solution lowers, however, the tensile properties (yield strength), so a higher wall thickness is necessary to operate at the same pressure, increasing weight and thus energy consumption related to the operation of the respective equipment.

(2) Hot rolling-quench and temper-straightening-surface machining-cut-assemblage of the parts.

(3) Hot rolling-pickling-cold drawing-quench and temper-straightening-surface machining-cut-assemblage of the parts.

In both of these cases (2), (3), surface quality and tolerances don't reach the standard required by the market for seamless precision tubes and thus require particularly expensive highly ablative downstream machining operations. Case (2) requires a preventive and consistent material removal through a boring operation, followed by skiving and burnishing or honing. In case (3) geometrical variations and distortions induced by martensitic transformation increase ovality and variability of the diameters, affecting the repeatability and the advantage of producing a precision steel tube. The treatment of Q&T also increases the production cost.

This means that, so far, either (i) the use of high wall thickness or (ii) the expense of high production costs is necessary to improve the low temperature performance of hydraulic cylinders.

In an effort to arrive at a production process not displaying the drawbacks of the cycles (1)-(3), an alternative cycle has been adopted in the past.

(4) Hot rolling-normalization (or on-line normalising)-cold drawing-stress relieving-straightening-surface machining-cut-assemblage of the parts.

While cycle (4) is advantageous from the point of view of the production costs, it guarantees nevertheless good longitudinal toughness only at room temperature and a sufficient one at 0° C. At temperatures below zero degrees, the variability of the process becomes too high and it's difficult to obtain consistent values. The transverse toughness is, on top of that, often unsatisfactory.

This means that cycle (4) does not improve the safety of the hydraulic cylinder, except in warm climatic conditions.

Hence, there remains an urgent need in the art for the provision of new seamless precision steel tubes with improved isotropic toughness at low temperature for hydraulic cylinders. Desirably, at a working temperature of −40° C.—reflecting usual conditions in specific areas of the planet—the minimum isotropic (i.e. longitudinal and transversal) toughness should be higher than the prescribed threshold limit of 27 J. On top of that, there remains an urgent need in the art for the provision of a new process for obtaining the aforementioned new tubes, the said new process being less expensive than the known cycles (1)-(4) as above.

The new process should be able to employ common low carbon steels, with a minimum content of Mn and Si, and possibly, but not necessarily micro-alloyed with one or more of the further elements, such as Cr, Ni, Mo, V, Nb, N. Al, Ca.

SUMMARY OF THE INVENTION is Applicants have now surprisingly found that the above-identified problems and further problems which will appear hereinafter, can be solved by a new process for manufacturing seamless precision steel tubes with improved isotropic toughness at low temperature for hydraulic cylinders comprising the following steps:

(i) providing a steel having a composition comprising 0.06-0.15% by weight of carbon and 0.30-2.5% by weight of Mn, and 0.10-0.60% by weight of Si, (ii) hot-rolling the said steel at a temperature higher than Ac3 such as to obtain a seamless steel tube, (iii) heating the said seamless steel tube at a temperature in the range between Ac1 and Ac3, (iv) quenching the said heated seamless steel tube, such as to establish a dual (or multi-) phase microstructure in the steel employed, composed of ferrite and martensite and optionally bainite and/or retained austenite, (v) cold drawing the quenched seamless steel tube such as to provide a seamless precision steel tube of the desired dimensions, (vi) subjecting the so-obtained seamless precision steel tube to stress relieving treatment to improve its toughness, and optionally (vii) straightening the so-obtained seamless precision steel tube.

According to a specific embodiment, the process step (ii) may be followed by a normalising step (iia) after hot rolling or may be designed as a normalising rolling (ii)' in order to intermediately refine grain and homogenise the structure prior to the subsequent step (iii).

Applicants have also found that precision seamless steel tubes obtainable by the aforementioned process display a yield strength of at least 520 MPa and a longitudinal and transversal toughness at −40° C. of at least 27J, preferably even a longitudinal and transversal toughness of at least 90 J at −20° C., and of at least 45 J at −40° C.

Therefore the new precision steels tubes with improved isotropic toughness allow for the provision of new hydraulic cylinders employable at very low temperatures.

DESCRIPTION OF THE FIGURES

The following

FIG. 1 is a graphic representation of an example of a hydraulic cylinder, as contemplated by the invention.

FIG. 2 is a representation of an example of a CVN transition curve of a typical seamless precision pipe obtainable according to the present invention after producing the same on industrial scale with the herein described process.

FIG. 3 is a representation displaying the values of longitudinal and transversal toughness [J] of a seamless pipe of the composition according to the example herein at −20° C., obtained after certain steps of the working cycle according to the present invention (right half of the graph), as opposed to the same pipe obtained instead through the traditional cycle (4) i.e. comprising the normalization treatment (left half of the graph).

In particular, in the left half of the graph, first dot, the longitudinal and transverse toughness at −20° C. measured before the cold drawing step of a pipe obtained according to cycle (4) are reported. The second dot shows the longitudinal toughness at −20° C. of the same pipe, measured after the cold drawing and stress relieving steps. The third dot shows the transversal toughness at −20° C. of the same pipe, measured after the cold drawing and stress relieving steps.

In particular, in the right half of the graph, first dot, the longitudinal and transverse toughness at −20° C. measured before the cold drawing step of a pipe obtained according to the present invention are reported. The second dot shows the longitudinal toughness at −20° C. of the same pipe, measured after the cold drawing and stress relieving steps. The third dot shows the transversal toughness at −20° C. of the same pipe, measured after the cold drawing and stress relieving steps.

DETAILED DESCRIPTION OF THE INVENTION

The inventors, with the aim of solving the above-mentioned problems, have thoroughly studied the cycles (1)-(4) and have analyzed the contribution of each of the production steps to the obtained (as opposed to the desired) features of the thereby manufactured tubes.

Figure 3:
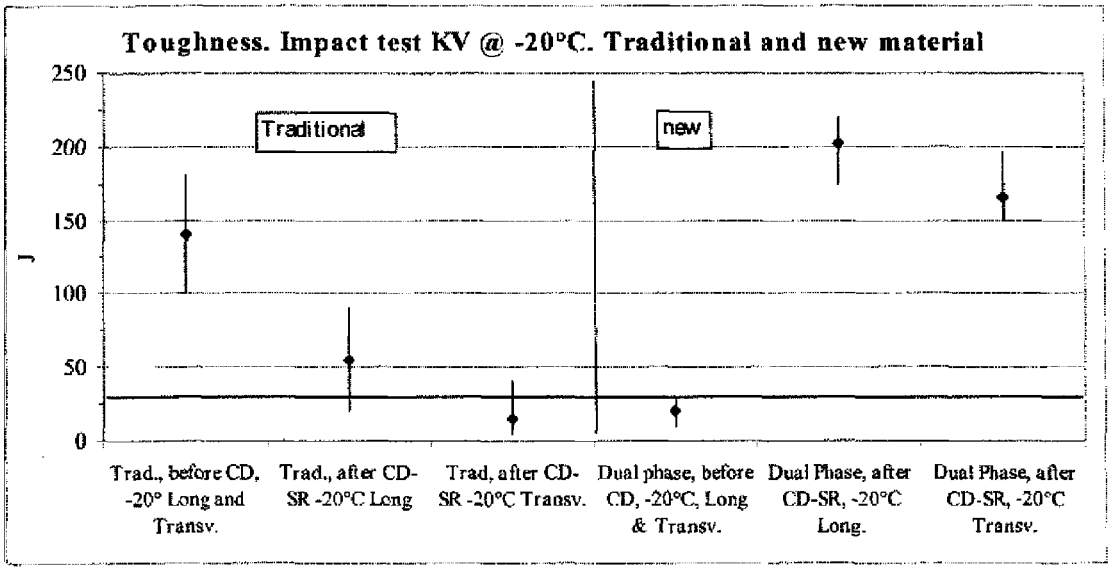

In particular, they have noted that while a satisfactory toughness is obtained through the normalization treatment according to cycle (4), the said toughness and in particular its isotropicity is almost completely lost during the subsequent cold-drawing step and cannot be fully re-stored through the subsequent stress-relieving treatment. According to the traditional treatment, such loss is particularly pronounced for the transversal toughness (see FIG. 3, left part).

However, the employment of a cold-drawing step in an improved new process is considered highly desirable because it is beneficial not only to the achievable yield strength, but also to the dimensional precision of the thereby obtained tube. On the other hand, while it is known, e.g. from U.S. Pat. No. 6,846,371 that so called intercritical heating (as opposed to normalizing)—by virtue of the thereby created so-called dual (or multiple) phase microstructure—may be beneficial for various features of a tube, comprising its yield strength, its toughness and even isotropicity of toughness, any down stream cold working treatment of the so-obtained tubes is nevertheless carefully avoided.

This is because, as is largely known, and as U.S. Pat. No. 6,846,371 highlights itself, the working of pipes at a non-recrystallization temperature range-due to the elongation undergone during such working—creates an inherent anisotropy in the material, improving the desired features in the deformation direction, but inevitably decreasing the same transversally to the working direction.

On the other hand, without cold working, no precision tubes are obtained, and thus, the pipes achieved according to U.S. Pat. No. 6,846,371—while satisfactory for their intended use (OTCG)—would be, in a manner similar to the pipes obtainable with working cycle (2) above, in the need of substantial, highly ablative downstream machining operations before being fit for precision applications, as the one contemplated by the present invention.

However, the inventors have now discovered that, unlike in the case of working cycle (4), when an intercritical heat treatment with subsequent quenching is followed by a cold drawing step within a process for obtaining precision tubes, it is nevertheless unexpectedly possible to achieve high isotropy of the cold worked tube's toughness through the subsequent stress relieving treatment. In particular, it is possible to achieve, during the stress relieving, a remarkable increase of the transversal (and also longitudinal) toughness. See FIG. 3, right part.

It thus appears that on top of providing, for the first time, without the need for highly ablative downstream machining operations, precision seamless steel tubes suited for hydraulic cylinders employable, if desired, at very low temperatures (lower than heretofore achievable), the new process also brings about an energy saving, due to the lower temperature applied during the intercritical heating as opposed to the traditional normalization step.

Figure 1:
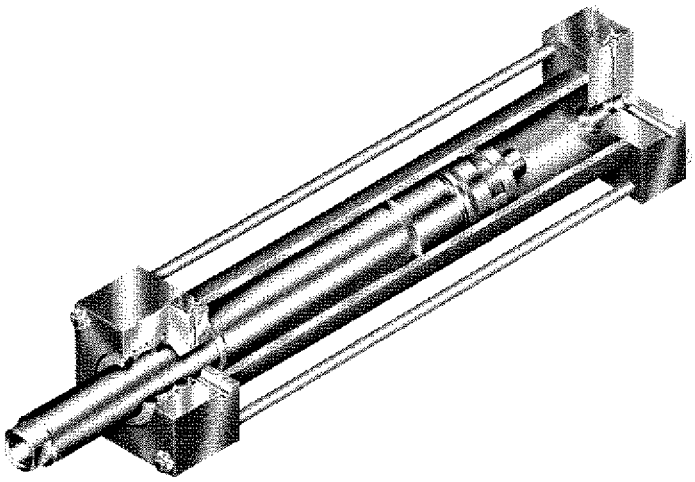
FIGS. 1-3 are attached to the present application for the sole purpose of illustrating some aspects of the present invention, yet without limiting the same.
Figure 2:
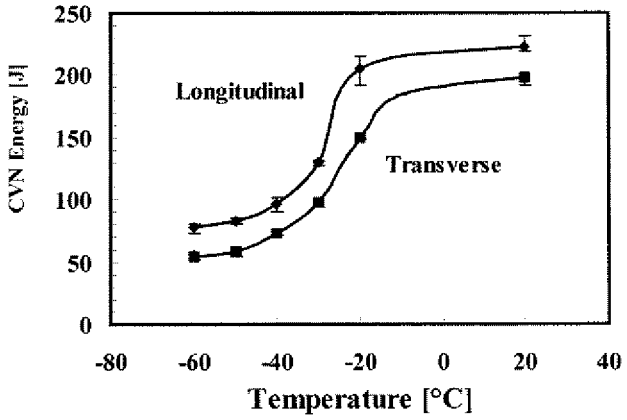

As apparent e.g. from FIG. 2, with the new process, excellent isotropic (longitudinal and transversal) toughness, e.g. at least 90 J at −20° C., and of at least 45 J at −40° C. (and more) is achievable.

The invention will now be explained more in detail.

For the production of the seamless precision steel tubes according to the present invention, steels with a carbon content in the range of 0.06%-0.15% by weight of carbon, are employable. The invention is not limited to particular steel compositions, but typically the steel will comprise, further to 0.06-0.15% by weight of carbon, 0.30-2.5% by weight of Mn, 0.10-0.60% by weight of Si. Preferably, the typical steel will comprise 0.40-2.10% by weight of Mn, and still more preferably 0.60-1.80% by weight of Mn. Optionally, the aforementioned steel will further comprise one or more of the following elements: Cr, Ni, Mo, V, Nb, N, and Al. The alloy elements employed should be adequately balanced in order to obtain the desired hardenability and strength at low cost. Those skilled in the art will not only be able to carry out such balancing, but they will also understand that the achievement of the desired hardenability is also possible through the employment of different alloy element mixes as the ones herein described. Of course it is also possible, where desired, to rely on different amounts of alloy elements than the ones herein described, obtaining nevertheless the desired hardenability.

Thus, preferred steel compositions employed in the present invention comprise, by weight, 0.06-0.15% C, 0.60-1.80% Mn, 0.10-0.60% Si, and optionally 0.0-0.60% Cr, 0.0-0.60% Ni, 0-0.50% Mo, 0-0.12% V, 0-0.040 Nb, 0.0040-0.02% N, 0.0-0.040% Al, the remainder being iron and inevitable impurities. Preferably, in the steels as above, the content of the following further elements should be limited as follows: P 250 ppm max., S 100 ppm max., preferably 50 ppm max., Ca 30 ppm max.

With the new cycle proposed by the inventors of the present application and adopting the herein disclosed chemistry, it is possible to reach excellent mechanical properties with low carbon steels. It is noted that the confinement to the lower carbon content as compared to the steels commonly employed in the heretofore known standard cycles brings about a better weldability.

Mn and Si are elements always present in carbon and low alloyed steels, as their role is the attainment of sufficient strength by solid solution strengthening of the ferrite matrix; in particular Mn increases significantly the hardenability. However, higher Mn values than the ones herein disclosed are not necessary for cost and because too high Mn levels could produce segregation in the bar during solidification.

Cr, Mo, V can be added at the herein specified levels to improve hardenability and strength after stress relieving, thanks to a secondary hardening during the heat treatment; Nb at the specified levels controls grain refinement during manufacturing process, helping to improve toughness and yield. The Nitrogen content can be controlled to the values herein proposed to have grain refinement with Al, which, at the levels herein specified can also be present as a deoxidizer.

In the steels employed in the present invention, S should be preferably limited to a value of 0.010% by weight (100 ppm) to avoid MnS formation which would be detrimental to transversal toughness, and preferably to 0.005% by weight (50 ppm). P is considered an impurity and should be limited to 0.25% by weight (250 ppm). Ca can be added to levels up to 0.003% by weight (30 ppm) max., to modify alumina inclusions eventually generated by the optional desoxidation process.

According to the present invention, the hot rolling of the steel according to step (ii) at temperature higher than Ac3 is carried out as follows: heating of a billet to a temperature over Ac3, piercing, rolling, and, optionally, finishing with a stretch reducing mill or a sizing mill. Accordingly, by carrying out step (ii), a hot finished seamless steel tube is obtained.

According to a specific embodiment, the process step (ii) may be followed by a normalising step (iia) after hot rolling or may be designed as a normalising rolling in order to intermediately refine grain and homogenise the structure prior to the subsequent step (iii). It must however be pointed out that conventional hot rolling as per step (ii) is fully sufficient to achieve the advantages of the herein described invention.

According to the present invention, the heating of the aforementioned hot finished seamless steel tube at a temperature in the range between Ac1 and Ac3, and its subsequent quenching according to steps (iii) and (iv) can be carried out by (a) by air cooling the steel as rolled until it reaches a temperature in the range between Ac1 and Ac3, and then quenching, the same to room temperature, or (b) by annealing the steel at temperature in the range between Act and Ac3 and then quenching the same to room temperature. The quenching should be carried out as rapidly as possible (preferably with water), the exact minimum cooling rate employable depending on the employed alloy's chemistry. Those skilled in the art will be capable to establish suitable minimum cooling rates to bring about, in the employed steels, the desired dual (or multi-) phase microstructure of. Such microstructure is constituted by a ferrite matrix, in which martensite and optionally bainite and/or retained austenite are dispersed.

Accordingly, through steps (iii) and (iv), quenched seamless steel tubes are obtained.

According to the present invention, the cold drawing of the quenched seamless steel tube according to step (v) such as to provide a seamless precision steel tube of the desired dimensions, is carried out preferably imparting a reduction of area (RA) between 8 and 30%, preferably between 10 and 25%. The former values are preferred such as to arrive at the desired tensile properties and surface tolerances. Accordingly, through step (v), seamless precision steel tubes are obtained.

According to the present invention, the subjecting of the so-obtained seamless precision steel tube to stress relieving treatment according to step (vi) to improve its isotropic toughness, is carried out heating the tubes to a temperature preferably between at least 0.72 Ac1 and 0.95Ac1 and cooling them in controlled atmosphere furnace or in air to room temperature. It has further been found by the inventors to that by carrying out the stress relieving treatment in the range comprised between 0.85Ac1 and 0.92Ac1, preferably between 0.87Ac1 and 0.91Ac1, it is possible to obtain particularly high transversal toughness at low temperature (and, on top of that remarkable toughness isotropicity), yet retaining the yield stress definitely higher than the normally required levels.

According to the present invention, the optional straightening of the so-obtained seamless precision steel tube with improved toughness according to step (vii) can be carried out passing the tube through a series of rolls that bend and press (crush) the pipe. With this operation, if at all necessary, a straightness of 1 mm/1000 mm can be achieved, which is beneficial for both, the later surface refining, and for the later use of the pipes as cylinders itself.

It is an important feature of the present invention that the tubes obtained by the process of the present invention, have narrow dimensional tolerances, very close to those required for their use as hydraulic cylinders. Typically, for ID (inner diameter) values up to 100 mm, a variation equal to or lower than 0.60% is achieved, whereas variations of less than 0.45%, preferably less than 0.30% are achievable for higher ID values.

This means not only that the tubes are fit for the subsequent machining, but more importantly that the said machining, rather than bringing about a high ablation of material, is merely a surface refining, thus considerably reducing material and time loss normally associated with this operations. After machining, the tolerances match those required for the intended use as hydraulic cylinders, e.g. ISO H8.

The invention is further illustrated in, though not limited through the following examples.

EXAMPLES

Experimental Procedure

A steel of the composition given below was obtained and processed according to the invention.

A fine tuning was performed first by laboratory tests to explore suitable processing conditions. The specimens were taken from as-rolled seamless pipes and subjected to a heat treatment at a temperature in the range between Ac1 and Ac3. Such treatment was performed in a muffle at temperatures from 750° C. to 820° C. (inter-critical treatment or annealing) followed by quenching in stirred water with a cooling rate (CR) of 60 to 70° C./s, measured by a thermocouple inserted at mid-thickness.

Tensile and Charpy V-notch (CVN) tests according to EN10002-1 and 10045-1 respectively were performed on specimens taken in the transverse and longitudinal directions. The transition curves in the temperature range −60° C. to 20° C., together with the Fracture Appearance Transition Temperature (50% FATT), were determined for the tested material.

An industrial trial was then designed on the basis of the results from the laboratory tests.

Design of the Inter-Critical Treatment.

The chemical composition of an industrial steel selected for the investigation is shown in Table 1.

TABLE 1

Chemical composition of the investigated steel.

| C % | Mn % | Si % | P ppm | S ppm | Ni % | Cr % | Mo % | V % | Nb % | Cu % | Al % | Ca ppm | N ppm |
|---|---|---|---|---|---|---|---|---|---|---|---|---|---|
| 0.09 | 1.14 | 0.27 | 130 | 20 | 0.41 | 0.13 | 0.14 | 0.07 | 0.024 | 0.17 | 0.028 | 17 | 48 |

The material was available as pipes of the following dimensions: OD=219 mm and WT=17 mm.

The critical temperatures, calculated by Andrews' empirical relationships (see K. W. Andrews: JISI Vol. 193 July (1965), p. 721) for the considered steel are as follows: $A_{C1}$=714-715° C., $A_{C3}$=831-833° C. and $M_S$=456-458° C.

Table 2 displays the results obtained after normalization and intercritical treatment as specified:

TABLE 2

Tensile properties and toughness values of laboratory IQ specimens.

| | IT | YS* | UTS | Y/T | EI | CVN Energy (J)** | | | |
|---|---|---|---|---|---|---|---|---|---|
| | [° C.] | [MPa] | [MPa] | [—] | [%] | Direction | +20° C. | −20° C. | −40° C. |
| Temperature of Intercritical treatment | 750 | 363 | 743 | 0.49 | 21.0 | Long. | 27 | 13 | 11 |
| | | n.d. | n.d. | n.d. | n.d. | Transverse | n.d. | 14 | n.d. |
| Temperature of Intercritical treatment | 785 | 400 | 784 | 0.51 | 22.5 | Long. | 60 | 29 | 20 |
| | | n.d. | n.d. | n.d. | n.d. | Transverse | n.d. | 28 | n.d. |

TABLE 2-continued

| Tensile properties and toughness values of laboratory IQ specimens. | | | | | | | | | |
|---|---|---|---|---|---|---|---|---|---|
| | IT | YS* | UTS | Y/T | EI | CVN Energy (J)** | | | |
| | [° C.] | [MPa] | [MPa] | [—] | [%] | Direction | +20° C. | −20° C. | −40° C. |
| Temperature of Intercritical treatment | 820 | 443 | 807 | 0.55 | 23.0 | Long. | 66 | 29 | 19 |
| | | n.d. | n.d. | n.d. | n.d. | Transverse | n.d. | 25 | n.d. |

*continuous yielding ($Rp_{0.2}$);
**average of three values (specimen size: 10 × 10 × 55 $mm^3$)

From the above table, it thus appears that after performing step (iv) according to the present invention, both, the long and the transverse toughness of the so far obtained tubes are by far insufficient.

Industrial Trials.

The industrial trials, performed on the steel as above included the following steps: hot rolling, intercritical heat treatment followed by quenching (IQ), cold drawing (CD), stress relieving (SR), straightening (S).

In some cases normalisation (step (iia)) before IQ has been carried out.

With Intermediate Normalisation.

For the industrial trials, a temperature of 780° C. ("Cycle A") and 810° C. ("Cycle B"), respectively reproducing two of the above conditions tested before in laboratory, was set for the intercritical treatment of the hollow. On top of that, the influence of two different reductions of area was explored in connection with cold drawing in Cycle B. The reductions of area adopted were 12.5% and 17.5%, with final dimensions of 160×13.0 mm and 160×12.1 mm respectively, see the following table:

Cycle A: IQ 780° C.-17.5%-SR 580° C.
Cycle B: IQ 810° C.-17.5%-SR 580° C.
Cycle C: IQ 810° C.-12.5%-SR 580° C.

The mechanical properties of the IQ tubes confirmed the results obtained in the laboratory:low Y/T ratio and high values of work-hardening coefficient (n=0.19-0.21). The achievement of a high n value is important in that the same is necessary to obtain high strength values after cold drawing. After CD the ultimate tensile strength (UTS) was greater than 950 MPa and toughness was strongly reduced (CVN energy<10 J at −20° C.). Yet the subsequent SR allowed to recover toughness (longitudinal and transversal) at levels equal or greater than 150 J even at low temperature (−20° C.). At even lower temperatures (−40° C.), toughness (longitudinal and transversal) was still higher than 70 J.

The said industrial stress relieving treatment has been carried out in a Nassehuer furnace, with heating zone 14.150 m long. Temperature was set at 580° C., with a tube speed of 15 m/h. The specific results are the following:

| | | | Tensile test | | | KV Long. (10 × 10 mm - Joule) | | | | | |
|---|---|---|---|---|---|---|---|---|---|---|---|
| Cycle | RA % | Stress relieving | Rs (MPa) | Rm (MPa) | E % | +20° C. | −20° C. | −30° C. | −40° C. | −50° C. | −60° C. |
| A | 17.5% | 580° C. | 713 | 762 | 19.0 | 211 | 183 | nd | 158 | nd | 117 |
| B | 17.5% | 580° C. | 719 | 776 | 20.0 | 223 | 206 | 130 | 97 | 83 | 78 |
| C | 12.5% | 580° C. | 668 | 730 | 18.4 | 221 | 218 | 206 | 196 | n.d | 148 |

| | KV Transv. (10 × 10 mm - Joule) | | | | | |
|---|---|---|---|---|---|---|
| Cycle | +20° C. | −20° C. | −30° C. | −40° C. | −50° C. | −60° C. |
| A | 189 | 154 | Nd | 135 | Nd | 102 |
| B | 198 | 150 | 98 | 73 | 58 | 55 |
| C | 208 | 191 | 182 | 134 | n.d. | 105 |

The material stemming from Cycle A was also treated in laboratory in controlled conditions, at different temperatures (560° C., 610° C., 650° C.) to explore the influence of the SR treatment. The following results have been obtained:

| | Stress | Tensile test | | | KV Long. (10 × 10 mm - Joule) | | | KV Trasv. (10 × 10 mm - Joule) | | |
|---|---|---|---|---|---|---|---|---|---|---|
| RA % | relieving | Rs (MPa) | Rm (MPa) | E % | +20° C. | −20° C. | −40° C. | +20° C. | −20° C. | −40° C. |
| 17.5% | 560° C. × 15' | 692 | 774 | 18.1 | 219 | 210 | nd | 202 | 206 | nd |
| 17.5% | 610° C. × 15' | 688 | 765 | 19.1 | 221 | 230 | nd | 214 | 206 | nd |

-continued

| RA % | Stress relieving | Tensile test Rs (MPa) | Rm (MPa) | E % | KV Long. (10 × 10 mm - Joule) +20° C. | −20° C. | −40° C. | KV Trasv. (10 × 10 mm - Joule) +20° C. | −20° C. | −40° C. |
|---|---|---|---|---|---|---|---|---|---|---|
| 17.5% | 650° C. × 15' | 657 | 730 | 19.3 | 271 | 273 | nd | 242 | 215 | nd |

Without Intermediate Normalizing Step.

A hollow 177.8×14.5 mm, with the following chemical analysis:

| C % | Mn % | Si % | P ppm | S ppm | Ni % | Cr % | Mo % | V % | Nb % | Cu % | Al % | Ca ppm | N ppm |
|---|---|---|---|---|---|---|---|---|---|---|---|---|---|
| 0.09 | 1.10 | 0.30 | 120 | 10 | 0.40 | 0.12 | 0.14 | 0.06 | 0.022 | 0.17 | 0.030 | 20 | 48 |

had been treated after hot rolling at 770° C. and quenched with water.

The critical temperatures, calculated by Andrews' empirical relationships (see K. W. Andrews: JISI Vol. 193 July (1965), p. 721) for this material, very similar to the prior one, are as follows: $A_{C1}$=714-715° C., $A_{C3}$=831-833° C. and $M_S$=456-458° C.

The tubes were cold drawn to the dimension 165×12.75 with a reduction of area of 18%.

A batch was treated at 560° C., giving the following results:

| RA % | Stress relieving | Tensile test Rs (MPa) | Rm (MPa) | E % | KV Long. (10 × 10 mm - Joule) +20° C. | −20° C. | −30° C. | −40° C. | −50° C. | −60° C. |
|---|---|---|---|---|---|---|---|---|---|---|
| 18% | 560° C. | 865 | 890 | 18.3 | n.d. | 170 | nd | 173 | nd | 74 |
| | | | | | KV Transv. (10 × 10 mm - Joule) | | | | | |
| | | | | RA % | +20° C. | −20° C. | −30° C. | −40° C. | −50° C. | −60° C. |
| | | | | 18% | n.d. | 118 | Nd | 60 | n.d. | n.d. |

In this case, very high tensile properties were obtained (Rs: 865 MPa) with transversal toughness at −40° C. still higher than 45 J.

A second batch was treated at 640° C., giving:

| RA % | Stress relieving | Tensile test Rs (MPa) | Rm (MPa) | E % | KV Long. (10 × 10 mm - Joule) +20° C. | −20° C. | −30° C. | −40° C. | −50° C. | −60° C. |
|---|---|---|---|---|---|---|---|---|---|---|
| 18% | 640° C. | 743 | 785 | 17 | 312 | 289 | n.d. | 317 | n.d. | 313 |
| | | | | | KV Transv. (10 × 10 mm - Joule) | | | | | |
| | | | | RA % | +20° C. | −20° C. | −30° C. | −40° C. | −50° C. | −60° C. |
| | | | | 18% | 277 | 316 | n.d. | 322 | n.d. | 299 |

In this case, tensile properties were reduced, but still largely acceptable, whereas remarkable transversal toughness values were attained.

It appears thus that in all cases the ability of the new process to obtain Yield strength higher than 620 MPa, preferably higher than 650 MPa, and excellent isotropic toughness at low temperature is confirmed.

CONCLUSIONS

The industrial trials have confirmed that the new process provided by the present invention can be used to produce seamless precision steel tubes displaying high strength levels (YS>620 MPa) after CD and SR, maintaining excellent toughness, down to −40° C., in both the transverse and longitudinal directions, thus displaying, in spite of the intermediate CD step, a remarkable isotropicity of the toughness at low temperature. The results here achieved are significantly better than those obtainable with the heretofore known processes. In particular, it appears that with the present invention, at −20° C., a longitudinal and transversal toughness (CVN energy) of at least 90 J, preferably of at least 140 J, and more preferably of at least 150 J can be achieved, whereas at −40° C., a longitudinal and transversal toughness (CVN energy) of at least 45 J, preferably of at least 60 J, and more preferably of at least 70 J can be achieved. Peak values of transversal toughness up to at least 200 kJ and more at −40° C. and excellent isotropicity may be obtained. Tensile properties and toughness, can be modulated with an appropriate fine tuning of the stress relieving temperature.

LITERATURE CITED

[1] D.O.T. §178.65 Spec. 39 Non reusable (non refillable) cylinders.
[2] Pressure Equipment Directive 97/23/EC.
[3] EN 10216-1/2/3/4, "Seamless steel tubes for pressure purposes", European Standard.

The invention claimed is:

1. A method for manufacturing seamless precision steel tubes with improved isotropic toughness at low temperature for hydraulic cylinders comprising the following steps:

(i) providing a steel having a composition comprising 0.06-0.15% by weight of carbon, 0.30-2.5% by weight of Mn, and 0.10-0.60% by weight of Si, (ii) hot-rolling the steel at a temperature higher than Ac3 to obtain a seamless steel tube, (iii) holding the seamless steel tube at a temperature in the range between Ac1 and Ac3, (iv) quenching the heated seamless steel tube to establish a multi-phase microstructure in the steel comprising ferrite and non-tempered martensite, (v) cold drawing the quenched seamless steel tube comprising ferrite and non-tempered martensite to provide a seamless precision steel tube of desired dimensions, and (vi) subjecting the seamless precision steel tube to stress relieving treatment to improve isotropic toughness.

2. The method according to claim 1 in which the composition further comprises 0.40-2.10% by weight Mn.

3. The method according to claim 2 in which the composition further comprises 0.60-1.80% by weight of Mn.

4. The method according to claim 1 in which the composition comprises one or more of the following elements: Cr, Ni, Mo, V, Nb, N, and Al.

5. The method according to claim 4 in which the composition of the steel, by weight percent, comprises the following elements: 0-0.60% Cr, 0-0.60% Ni, 0-0.50% Mo, 0-0.12% V, 0-0.040% Nb, 0.0040-0.02% N, 0.0-0.040% Al, and the remainder being iron and inevitable impurities.

6. The method according to claim 4 in which the composition of the steel, by weight, further comprises the following elements: less than 0.025% of P, less than 0.010% of S, and less than 0.003% of Ca.

7. The method according to claim 6 in which the composition of the steel, by weight percent, further comprises less than 0.005% of S.

8. The method according to claim 1 in which process step (ii) is followed by a normalizing step (iia) after hot rolling in order to intermediately refine grain and homogenize the structure prior to the subsequent step (iii).

9. The method according to claim 8 wherein the normalizing step (iia) is designed as a normalizing rolling.

10. The method according to claim 1, wherein the steel is air cooled between steps (ii) and (iii) from a temperature higher than Ac3 to a temperature in the range between Ac1 and Ac3.

11. The method according to claim 10 in which the quenching is carried out in water.

12. The method according to claim 10 wherein the multi-phase microstructure further comprising bainite and/or retained austenite.

13. The method according to claim 1, in which steps (iii)-(iv) are carried out by annealing the steel at a temperature in the range between Ac1 and Ac3 and then quenching the same, such as to establish a multi-phase microstructure comprising ferrite and non-tempered martensite.

14. The method according to claim 13 wherein the multi-phase microstructure further comprising bainite and/or retained austenite.

15. The method according to claim 13 in which the quenching is carried out in water.

16. The method according to claim 1 in which the cold-drawing of step (v) is carried out such as to perform a reduction in area between 8 and 30%.

17. The method according to claim 16 in which the cold-drawing of step (v) is carried out such as to perform a reduction in area between 10% and 25%.

18. The method according to claim 1 in which the stress-relieving treatment according to step (vi) is carried out at a temperature between $0.72Ac_1$ and $0.95Ac_1$, wherein $Ac_1$ is in ° C.

19. The method according to claim 18 in which the stress-relieving treatment according to step (vi) is carried out in a controlled atmosphere furnace.

20. The method according to claim 18, in which step (vi) is carried out at a temperature between 0.85Ac1 and 0.92Ac1, wherein Ac1 is in ° C.

21. The method according to claim 20, in which step (vi) is carried out at a temperature between $0.87Ac_1$-$0.91Ac_1$, wherein $Ac_1$ is in ° C.

22. The method according to claim 1 wherein the multi-phase microstructure further comprises bainite and/or retained austenite.

23. The method according to claim 1 further comprising straightening the so-obtained seamless precision steel tube with improved toughness.

* * * * *

UNITED STATES PATENT AND TRADEMARK OFFICE

CERTIFICATE OF CORRECTION

PATENT NO. : 8,926,771 B2
APPLICATION NO. : 12/306917
DATED : January 6, 2015
INVENTOR(S) : Gianmario Agazzi It is certified that error appears in the above-identified patent and that said Letters Patent is hereby corrected as shown below:

In the Specification

In column 3 at line 23, Change “is Applicants” to --Applicants--.

In column 6 at line 33, Change “rolling in” to --rolling (ii)’ in--.

In column 7 at line 4, After “inventors” delete “to”.

In the Claims

In column 13 at line 51, In Claim 6, change “claim 4” to --claim 5--.

Signed and Sealed this
Twenty-ninth Day of September, 2015

Michelle K. Lee

Michelle K. Lee
*Director of the United States Patent and Trademark Office*